US011040532B2

(12) United States Patent
Koshiba

(10) Patent No.: US 11,040,532 B2
(45) Date of Patent: Jun. 22, 2021

(54) INKJET PRINTER

(71) Applicant: MIMAKI ENGINEERING CO., LTD., Nagano (JP)

(72) Inventor: Sho Koshiba, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/441,005

(22) Filed: Jun. 14, 2019

(65) Prior Publication Data

US 2019/0381792 A1 Dec. 19, 2019

(30) Foreign Application Priority Data

Jun. 18, 2018 (JP) ..... JP2018-115638

(51) Int. Cl.
*B41J 2/165* (2006.01)
*B41J 2/14* (2006.01)
*B41J 2/21* (2006.01)

(52) U.S. Cl.
CPC ..... *B41J 2/14024* (2013.01); *B41J 2/1433* (2013.01); *B41J 2/16505* (2013.01); *B41J 2/16544* (2013.01); *B41J 2/2107* (2013.01)

(58) Field of Classification Search
CPC ..... B41J 2/16505
USPC ..... 347/29
See application file for complete search history.

(56) References Cited

U.S. PATENT DOCUMENTS

2007/0139465 A1* 6/2007 Nakashima ..... B41J 2/16523 347/35
2008/0198196 A1* 8/2008 Chikamoto ..... B41J 2/16508 347/29
2012/0249671 A1* 10/2012 Shimizu ..... B41J 2/16508 347/29
2014/0240395 A1* 8/2014 Shindo ..... B41J 2/16505 347/29
2016/0031220 A1* 2/2016 Murayama ..... B41J 2/16535 347/33

FOREIGN PATENT DOCUMENTS

JP 2003159822 A * 6/2003 ..... B41J 2/16508
JP 2018069713 5/2018

OTHER PUBLICATIONS

Machine generated English translation of JP2003159822 to Kumai, entitled "Ink-Jet Recording Apparatus"; translation retrieved from https://worldwide.espacenet.com/advancedSearch?DB=EPODOC&submitted=false&locale=en_EP&AB=&ST=advanced&compact=false on Apr. 8, 2020; 15pp.*

* cited by examiner

*Primary Examiner* — Shelby L Fidler
(74) *Attorney, Agent, or Firm* — JCIPRNET

(57) ABSTRACT

An inkjet printer is provided. Inclined surfaces of a first protrusion and a second protrusion of a first inkjet head and inclined surfaces of side walls of a head cap abut against each other, but other portions of the first inkjet head do not abut against the head cap. Specifically, the head cap 510 is not abutted against the lower surface 133 of the first inkjet head 130, and is also not abutted against the ejection surfaces 134A and 135A of the first protrusion 134 and the second protrusion 135. In particular, the side walls are formed to a shape so as not to overlap the ejection surfaces when viewed in the vertical direction, whereby the head cap does not abut against the ejection surfaces.

12 Claims, 12 Drawing Sheets

INKJET PRINTER

CROSS REFERENCE TO RELATED APPLICATIONS

This application claims the priority benefit of Japanese Patent Application No. 2018-115638, filed on Jun. 18, 2018. The entirety of the above-mentioned patent application is hereby incorporated by reference herein and made a part of this specification.

TECHNICAL FIELD

The present disclosure relates to an inkjet printer.

DESCRIPTION OF THE BACKGROUND ART

The inkjet printer includes a head cap that covers an ejection surface of an inkjet head (lower surface where an ink ejection port is provided) when performing maintenance on the inkjet head, for example, when purging, flushing, or suctioning ink in the nozzle (e.g., Japanese Unexamined Patent Publication No. 2018-69713 (Patent Literature 1)).

Patent Literature 1: Japanese Unexamined Patent Publication No. 2018-69713

SUMMARY

The inventors of the present disclosure found that in an inkjet printer that uses a head cap of the conventional art, a large amount of ink remains on the ink ejection surface after the maintenance. If a large amount of ink remains, the ink may be solidified at the ejection port for ejecting the ink and clogging may occur. Furthermore, when collectively wiping a plurality of ejection surfaces that eject different inks after the maintenance, another ink may affect the ejection port of one ink by the wiping (e.g., the other ink may enter the ejection port of the one ink by the wiping), and color mixing may occur.

The present disclosure provides an inkjet printer in which the amount of ink remaining on the ejection surface after maintenance is small.

An inkjet printer according to a first aspect of the present disclosure includes an inkjet head including a first protrusion that protrudes downward, the first protrusion having a lower surface provided with a first ejection port for ejecting a first ink as a first ejection surface; and a head cap mounted to the inkjet head when ejecting the first ink from the first ejection port to perform a maintenance on the inkjet head; where the head cap includes a first bottom portion, and a first side wall extending from the first bottom portion toward a side of the inkjet head; the first bottom portion and the first side wall form a first recess that covers the first ejection port when the head cap is mounted to the inkjet head; and the first side wall has a shape in which at least a part of an upper end portion of the first side wall abuts against a region at a periphery of the first ejection surface and does not abut against the first ejection surface when the head cap is mounted to the inkjet head.

The inventors of the present application have found that the reason why the amount of ink remaining on the ejection surface after maintenance is large is because the upper end of the head cap abuts against the ejection surface (see e.g., cap member in Japanese Unexamined Patent Publication No. 2018-69713). Therefore, in the disclosure of the present application, the first side wall is shaped so that at least a part of an upper end portion thereof abuts against a region at a periphery of the first ejection surface and does not abut against the first ejection surface when the head cap is mounted to the inkjet head. The amount of ink remaining on the ejection surface after maintenance can be reduced by adopting such a configuration.

The first protrusion may include a side surface having an inclined surface, and the upper end portion of the first side wall may include an abutment portion that abuts against the inclined surface.

With such a configuration, the head cap is suitably mounted to the inkjet head.

The first protrusion may include a side surface having an inclined surface; and the upper end portion of the first side wall may include an abutment portion that abuts against the inclined surface and a periphery of the side surface of the inkjet head.

With such a configuration, the head cap is suitably mounted to the inkjet head.

The maintenance may be a maintenance by purge.

The inventors of the present application have found that the amount of ink remaining on the ejection surface after maintenance is large particularly when performing purge as maintenance. Therefore, the amount of ink remaining on the ejection surface after maintenance can be effectively reduced by adopting the configuration described above.

The first ejection surface may be a surface from which the first ink is wiped by wiping.

According to the above configuration, the ink remaining on the ejection surface after maintenance can be wiped off.

The inkjet head may further include a second protrusion that protrudes downward, the second protrusion having a lower surface provided with a second ejection port for ejecting a second ink as a second ejection surface; when the head cap is mounted to the inkjet head, the first ink and the second ink may be ejected from the first ejection port and the second ejection port, respectively; the head cap may include a second bottom portion, and a second side wall extending from the second bottom portion toward the side of the inkjet head; the second bottom portion and the second side wall may form a second recess that covers the second ejection port when the head cap is mounted to the inkjet head; the inkjet printer may further include a wiping member that collectively wipes the first ejection surface and the second ejection surface after the maintenance; and the second side wall may have a shape in which at least a part of an upper end portion of the second side wall abuts against a region at a periphery of the second ejection surface and does not abut against the second ejection surface when the head cap is mounted to the inkjet head.

Mixing of color can be prevented by adopting the configuration described above.

According to the present disclosure, an inkjet printer in which the amount of ink remaining on the ejection surface after maintenance is small can be provided.

BRIEF DESCRIPTION OF THE DRAWINGS

FIG. 3 is a configuration view of an ink supply mechanism and the like.

DESCRIPTION OF EMBODIMENTS

Hereinafter, an inkjet printer 10 according to one embodiment of the present disclosure will be described with reference to the attached drawings.

(Schematic Configuration of Inkjet Printer 10)

Figure 1:
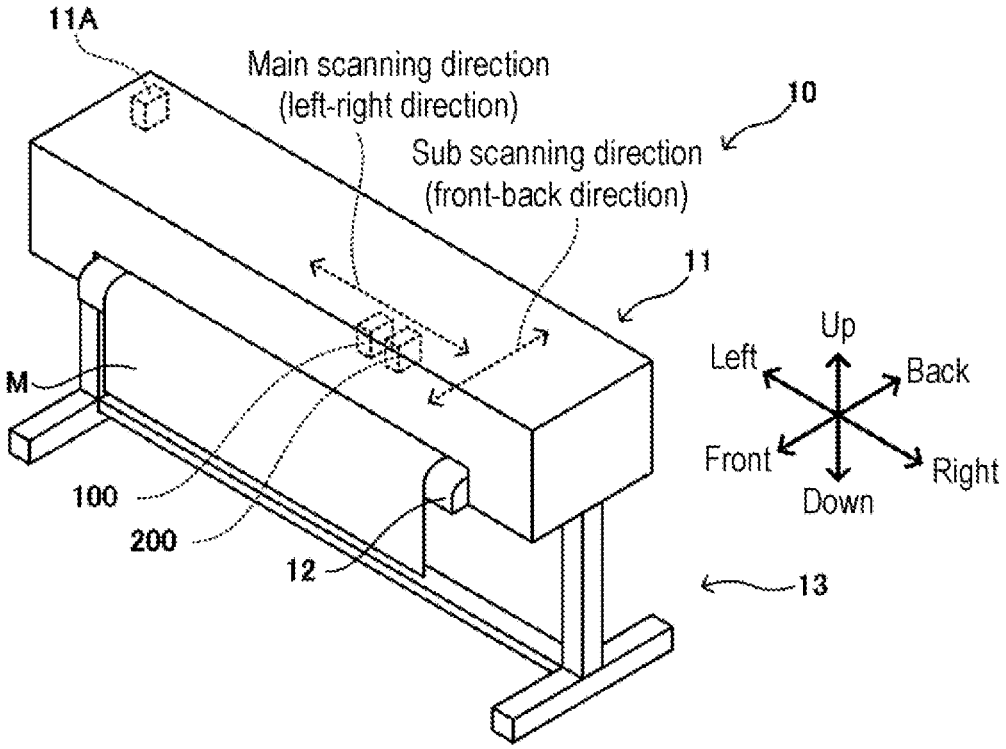
FIG. 1 is a schematic overall view of an inkjet printer according to one embodiment of the present disclosure.

As shown in FIG. 1, the inkjet printer 10 includes a printer main body 11, a conveying apparatus 12, and a frame 13. The inkjet printer 10 is configured to print an image on a medium (here, paper) M through an inkjet method.

Figure 5:
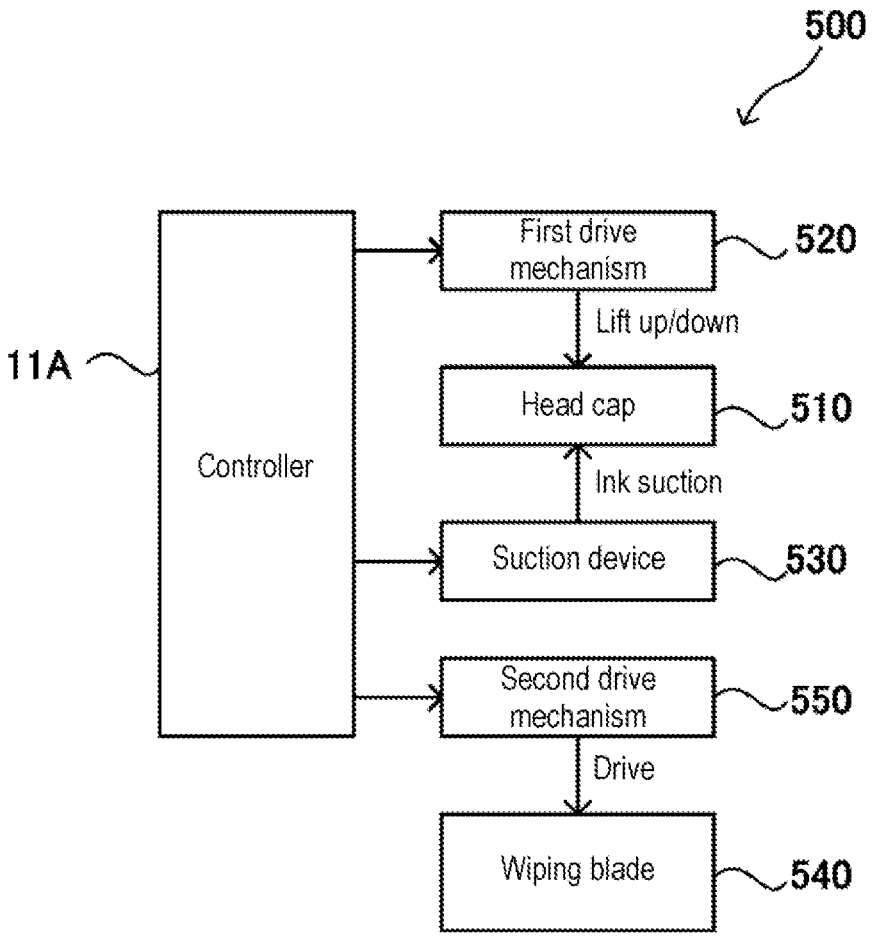
FIG. 5 is a configuration view of a maintenance mechanism.

The printer main body 11 is a portion that prints an image, and is supported by the frame 13 together with the conveying apparatus 12. The conveying apparatus 12 transports the medium M from the back toward the front along a sub scanning direction (front-back direction) by, for example, a roller. The printer main body 11 includes a first head unit 100 and a second head unit 200 configured to eject the ink to the medium M through the inkjet method. The first head unit 100 and the second head unit 200 are mounted on a carriage (not shown) movably provided in a main scanning direction, and move along the main scanning direction by the movement of the carriage. The printer main body 11 also includes a controller 11A that controls the operation of the inkjet printer 10. Although the details will be described later, the printer main body 11 has a maintenance mechanism 500 (see FIG. 5 etc., not shown in FIG. 1) for performing maintenance (cleaning) on the first head unit 100 and the second head unit 200.

In the inkjet printer 10, a process in which the first head unit 100 and the second head unit 200 eject ink while moving along the main scanning direction, and a process in which the conveying apparatus 12 moves the medium M along the sub scanning direction are repeatedly carried out. These processes are performed under the control of the controller 11A. An image is formed (printed) on the medium M by the ejected ink by repeatedly carrying out such processes.

(First Head Unit 100 and Second Head Unit 200)

Figures 2A, 2B:
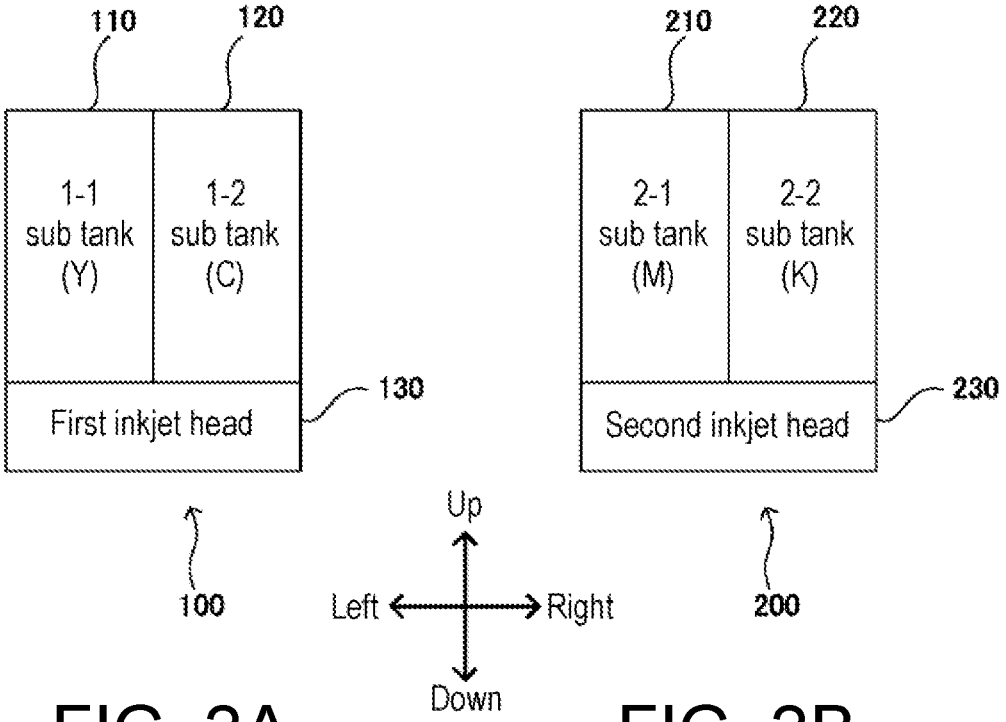
FIGS. 2A and 2B are configuration views of a first head unit and a second head unit.

As shown in FIG. 2A, the first head unit 100 includes a 1-1 sub tank 110, a 1-2 sub tank 120, and a first inkjet head 130. The 1-1 sub tank 110 and the 1-2 sub tank 120 are disposed on the first inkjet head 130.

The 1-1 sub tank 110 stores ink of Y (yellow) (hereinafter, also referred to as yellow ink). The 1-2 sub tank 120 stores ink of C (cyan) (hereinafter also referred to as cyan ink). The first inkjet head 130 individually ejects the yellow ink and the cyan ink supplied from the 1-1 sub tank 110 and the 1-2 sub tank 120. The first inkjet head 130 ejects ink in the form of droplets through a piezoelectric method or a thermal method.

As shown in FIG. 2B, the second head unit 200 includes a 2-1 sub tank 210, a 2-2 sub tank 220, and a second inkjet head 230. The 2-1 sub tank 210 and the 2-2 sub tank 220 are mounted on the second inkjet head 230.

The 2-1 sub tank 210 stores ink of M (magenta) (hereinafter also referred to as magenta ink). The 2-2 sub tank 220 stores ink of K (key plate, here, black) (hereinafter also referred to as black ink). The second inkjet head 230 individually ejects the magenta ink and the black ink supplied from the 2-1 sub tank 210 and the 2-2 sub tank 220. The second inkjet head 230 ejects ink in the form of droplets through a piezoelectric method or a thermal method.

(Ink Supply Mechanism 300)

The printer main body 11 also includes an ink supply mechanism 300 that supplies ink to the 1-1 sub tank 110, the 1-2 sub tank 120, the 2-1 sub tank 210, and the 2-2 sub tank 220.

Figure 3:
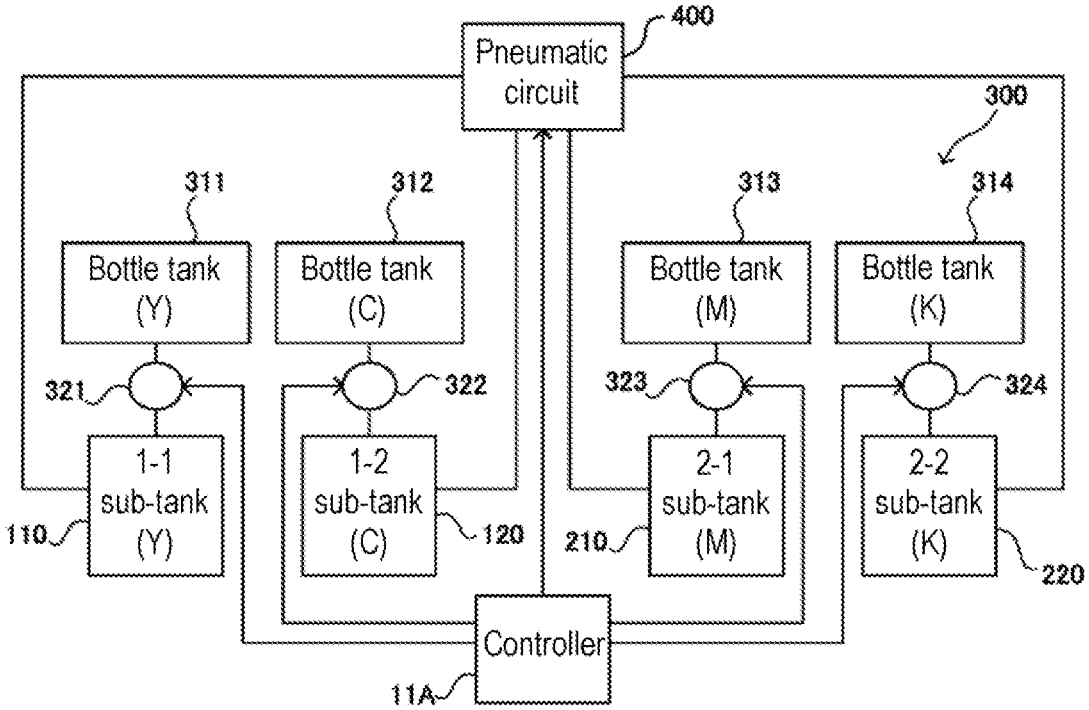

As shown in FIG. 3, the ink supply mechanism 300 includes bottle tanks 311 to 314 and pumps 321 to 324.

The bottle tank 311 is connected to a bottle for yellow ink (not shown, and stores the yellow ink supplied from the bottle. Similarly, the bottle tank 312 is connected to a bottle for cyan ink (not shown) and stores the cyan ink supplied from the bottle. The bottle tank 313 is connected to a bottle for magenta ink (not shown) and stores the magenta ink supplied from the bottle. The bottle tank 314 is connected to a bottle for black ink (not shown) and stores the black ink supplied from the bottle.

Each of the bottle tanks 311 to 314 is connected to each of the four sub tanks (1-1 sub tank 110, 1-2 sub tank 120, 2-1 sub tank 210, and 2-2 sub tank 220). Each ink stored in the bottle tanks 311 to 314 is supplied to each of the four sub tanks. The supply/non-supply of ink is controlled by the pumps 321-324.

Each of the four sub tanks is provided with a liquid level sensor (not shown) that detects the liquid level of the ink. The controller 11A individually controls each of the pumps 321 to 324 based on the signal from the liquid level sensor so that each of the four sub tanks is filled with ink of greater than or equal to a predetermined amount. For example, when detecting that the liquid level of the ink stored in the 1-1 sub tank 110 is lower than a predetermined position by the liquid level sensor, the controller 11A drives the pump 321 and performs a control to supply the yellow ink from the bottle tank 311 to the 1-1 sub tank 110.

The printer main body 11 also includes a pneumatic circuit 400 of FIG. 3. The pneumatic circuit 400 is configured to include a pneumatic pump, an air chamber, a slot valve and the like, and adjusts the air pressure in the four sub tanks (air pressure of the gas above the ink liquid level) under the control of the controller 11A. The pneumatic circuit 400 usually supplies a negative pressure, and supplies a positive pressure at the time of maintenance (purge herein) to be described later. The pneumatic circuit 400 may commonly supply negative pressure or positive pressure to each of the four sub tanks, or may supply the pressure individually and independently.

Figure 4A:
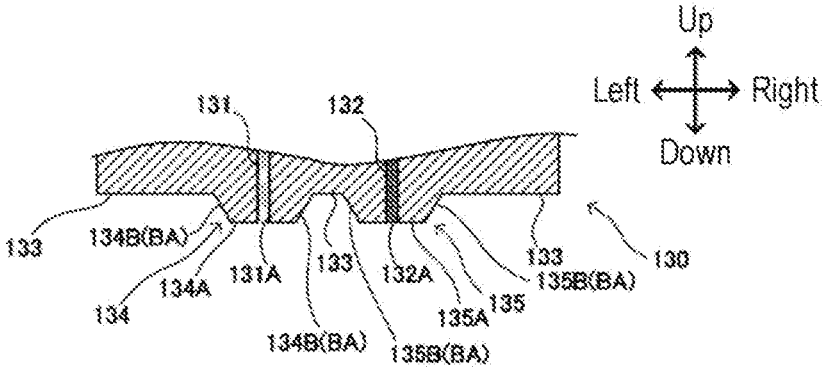
FIG. 4A is a cross-sectional view of the first inkjet head take along a short side direction.
Figure 4B:
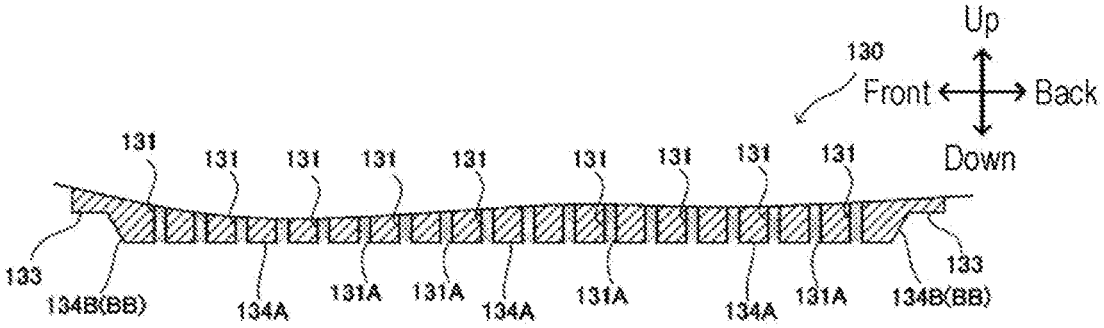
FIG. 4B is a cross-sectional view of the first inkjet head taken along a longitudinal direction.

Since the ink is always stored in the four sub tanks, the ink supply path from the sub tank to the ink ejection port of the first inkjet head 130 or the second inkjet head 230 is filled with ink. When positive pressure is supplied to the sub tank, the ink in the sub tank is pushed, and the ink is ejected (purge) from the ejection port of the first inkjet head 130 or the second inkjet head 230. For example, when the positive pressure is supplied to the 1-1 sub tank 110, the yellow ink is ejected from the ejection port 131A (FIG. 4) of the yellow ink in the first inkjet head 130.

(Ejector of First Inkjet Head 130 and Second Inkjet Head 230)

The lower part of the first inkjet head 130 is an ejector that ejects yellow ink and cyan ink. The ejector of the first inkjet head 130 includes, in addition to a plurality of ejection nozzles 131 and 132, a lower surface 133 facing downward, a first protrusion 134 protruding from the lower surface 133, and a second protrusion 135 protruding from the lower surface 133.

The plurality of ejection nozzles 131 are provided to pass through the inside of the first protrusion 134. The plurality of ejection nozzles 131 are arranged in the sub scanning direction, and can each eject the yellow ink independently. The plurality of ejection nozzles 132 are provided to pass through the inside of the second protrusion 135. The plurality of ejection nozzles 132 are arranged in the sub scanning direction, and can each eject the cyan ink independently.

The lower surface 133 forms the lower surface of the first inkjet head 130, and is also a region at the periphery of the first protrusion 134 and the second protrusion 135.

The first protrusion 134 and the second protrusion 135 are long in the sub scanning direction, and are formed to a quadrangular pyramid shape in which a short-side cross-section taken along the main scanning direction is a trapezoidal shape.

The first protrusion 134 has an ejection surface 134A (lowermost surface, corresponding to upper surface of quadrangular pyramid) which is a lower surface facing downward. The ejection surface 134A is provided with an opening on the lower side of the ejection nozzle 131, that is, an ejection port 131A for yellow ink. Furthermore, the first protrusion 134 includes an inclined surface 134B (corresponding to side surface of quadrangular pyramid) at the periphery of the ejection surface 134A. The inclined surface 134B is a surface in which an angle formed with the ejection surface 134A is an obtuse angle. The inclined surface 134B is located between the ejection surface 134A and the lower surface 133. The inclined surface 134B includes a first inclined surface 134BA extending along the sub scanning direction (longitudinal direction of first protrusion 134), and a second inclined surface 134BB extending along the main scanning direction (short side direction of first protrusion 134).

The second protrusion 135 has a shape similar to the first protrusion 134. The second protrusion 135 includes an ejection surface 135A provided with an opening on the lower side of the ejection nozzle 132, that is, an ejection port 132A for cyan ink. Furthermore, the second protrusion 135 includes an inclined surface 135B. The inclined surface 135B includes a first inclined surface 135BA extending along the sub scanning direction and a second inclined surface (not shown) extending along the main scanning direction.

(Maintenance Mechanism 500)

The maintenance mechanism 500 in the printer main body 11 is a mechanism that performs maintenance to prevent clogging of the ejection nozzles of the first inkjet head 130 and the second inkjet head 230. The first head unit 100 and the second head unit 200 are subjected to maintenance at an appropriate timing when located at the standby position.

The maintenance mechanism 500 includes a head cap 510, a first drive mechanism 520, a suction device 530, a wiping blade 540, and a second drive mechanism 550. The maintenance mechanism 500 is prepared for the first inkjet head 130 and for the second inkjet head 230, but as each maintenance mechanism 500 has the same structure, only the maintenance mechanism 500 for the first inkjet head 130 will be described herein.

The head cap 510 is mounted (abutted herein) to the first inkjet head 130 at the time of maintenance, and covers the ejection surface 134A of the first protrusion 134 and the ejection surface 135A of the second protrusion 135 and receives the ink ejected therefrom by purging. The head cap 510 includes a first recess 511 and a second recess 512 that accommodates ink, respectively. The first recess 511 and the second recess 512 are formed to a shape corresponding to the first protrusion 134 and the second protrusion 135, and are long in the sub scanning direction. When the head cap 510 is mounted to the first inkjet head 130, the first recess 511 accommodates and covers the first protrusion 134, the ejection surface 134A, and the ejection port 131A. The second recess 512 accommodates and covers the second protrusion 135, the ejection surface 135A, and the ejection port 132A.

The head cap 510 includes a bottom portion 513 and a side wall 514 extending upwardly from the bottom portion 513. The side wall 514 has a shape combining two squares when viewed from above, and the first recess 511 and the second recess 512 are defined by the bottom portion 513 and the side wall 514. A portion that defines the first recess 511 in the bottom portion 513 is referred to as a first bottom portion 513A, and a portion that defines the second recess 512 is referred to as a second bottom portion 513B. A portion (one square portion) that defines the first recess 511 in the side wall 514 is referred to as a first side wall 514A, and a portion (one square portion) that defines the second recess 512 is referred to as a second side wall 514B.

The first bottom portion 513A has a through hole 513C at the middle. The second bottom portion 513B has a through hole 513D at the middle. The through hole 513C and the through hole 513D are for discharging the ink stored in the first recess 511 and the second recess 512 in the purge to be described later. A plurality of through holes 513C and a plurality of through holes 513D may be provided.

The upper surface of the first side wall 514A has an inclined surface 514C. The inclined surface 514C includes a first inclined surface 514CA extending in the sub scanning direction and a second inclined surface 513CB extending in the main scanning direction. The first side wall 514A is shaped so as not to abut against the ejection surface 134A of the first protrusion 134.

The upper surface of the second side wall 514B has an inclined surface 514D. The inclined surface 514D includes a first inclined surface 514DA extending in the sub scanning direction and a second inclined surface 513DB extending in the main scanning direction. The second side wall 514B is shaped so as not to abut against the ejection surface 135A of the second protrusion 135.

In the head cap 510, an upper end portion of the side wall 514, that is, a portion that abuts against the first protrusion 134 and the second protrusion 135 is formed of an elastic material such as rubber, synthetic resin or the like so as to have elasticity, or may be formed by coating a metal, and the like with an elastic material.

The first drive mechanism 520 moves the head cap 510 up and down under the control of the controller 11A. The first drive mechanism 520 is configured to include a ball screw, a rack and pinion, and the like. The first drive mechanism 520 locates the head cap 510 at the lower position at the time of normal operation (time of non-maintenance), and moves the head cap 510 upward and mounts (abuts herein) it to the first inkjet head 130 at the time of maintenance.

The suction device 530 includes one for the first recess 511 (hereinafter also referred to as a first suction device) and one for the second recess 512 (hereinafter also referred to as a second suction device), but as both suction devices have the same structure, the first suction device will be described here.

Figure 6A:
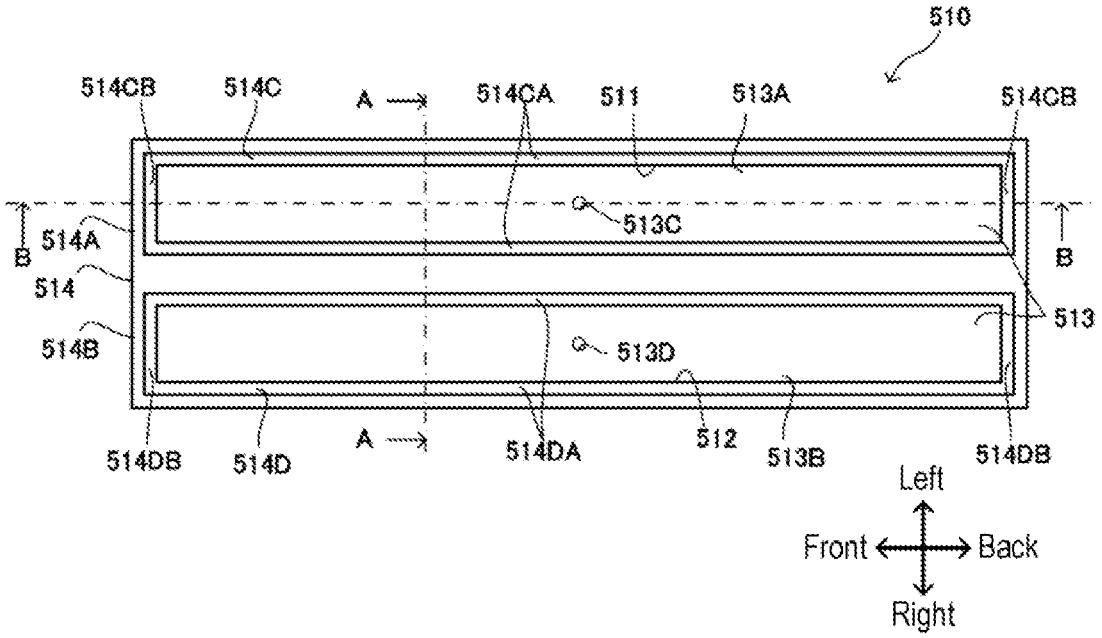
FIG. 6A is a plan view of a head cap.
Figure 6B:
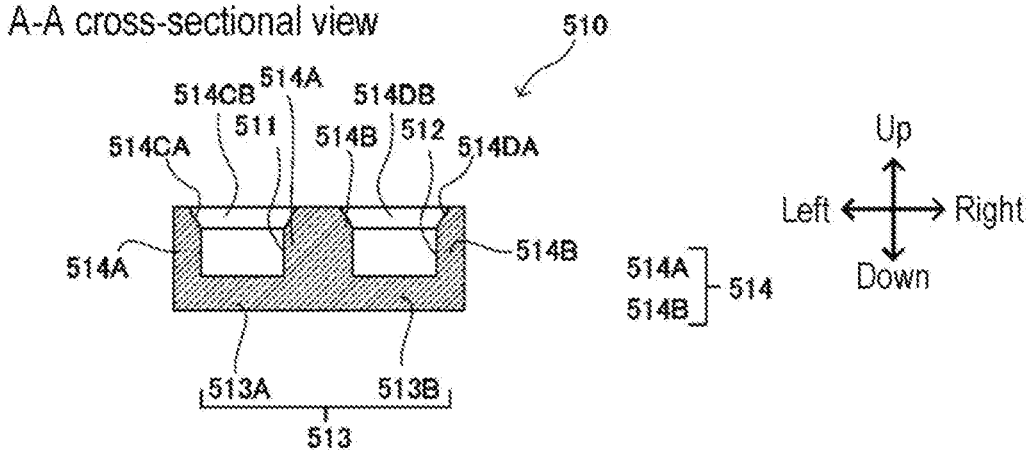
FIG. 6B is a cross-sectional view of the head cap taken along a short side direction.
Figure 6C:
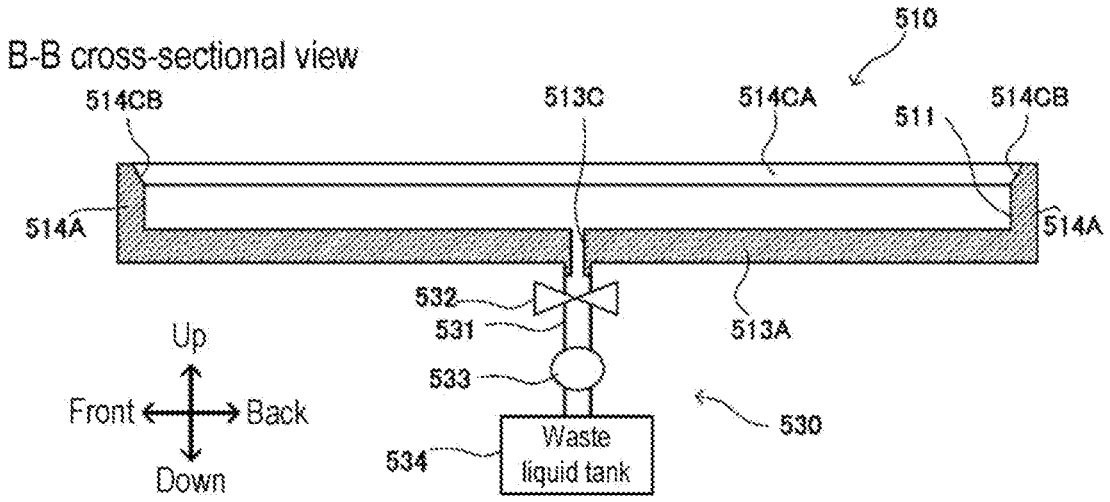
FIG. 6C is a cross-sectional view of the head cap taken along a longitudinal direction.

As shown in FIG. 6, the suction device 530 (first suction device) includes an ink flow path 531, a valve (electromagnetic valve etc.) 532, a pump 533, and a waste liquid tank 534. The suction device 530 (first suction device) suctions yellow ink (details will be described later) accumulated in the first recess 511 at the time of purge.

The ink flow path 531 is connected to the through hole 513C provided in the first bottom portion 513A. The ink flow path 531 flows the yellow ink (described in detail later) accumulated in the first recess 511 of the head cap 510 into the waste liquid tank 534. The valve 532 and the pump 533 are provided in the middle of the ink flow path 531 and control the flow of the yellow ink under the control of the controller 11A (details will be described later).

The wiping blade 540 is a plate-shaped elastic material, and wipes off the ink attached to the ejection surfaces 134A and 135A (details will be described later) by moving while making contact with the ejection surfaces 134A and 135A.

The second drive mechanism 550 drives the wiping blade 540 under the control of the controller 11A. The second drive mechanism 550 is configured to include a linkage mechanism, a ball screw, a pinion and rack, or the like.

(Maintenance)

Although the maintenance is performed with respect to the first inkjet head 130 and the second inkjet head 230, as both operations are the same, the maintenance of the first inkjet head 130 will be described below.

(Mounting of Head Cap 510)

Figure 7A:
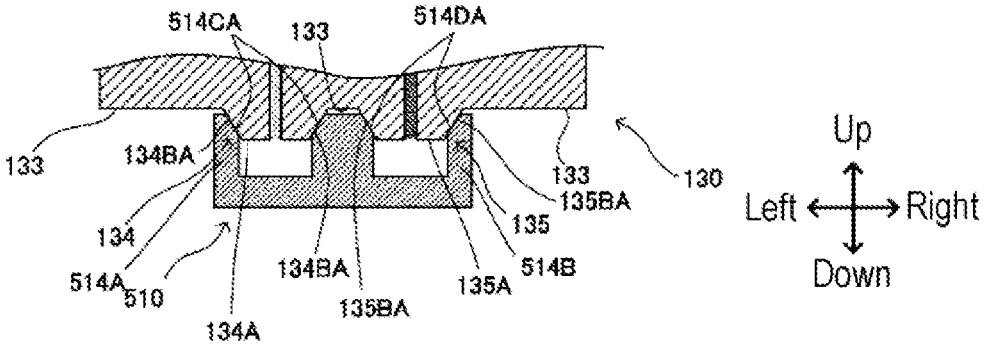
FIG. 7A is a cross-sectional view of that in which the head cap is mounted to the first inkjet head is taken along a short side direction.
Figure 7B:
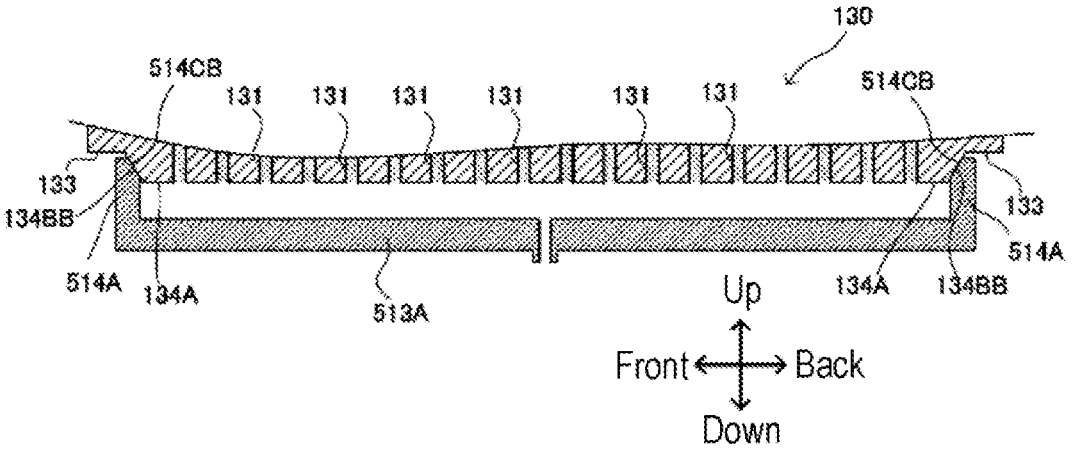
FIG. 7B is a cross-sectional view of that in which the head cap is mounted to the first inkjet head is taken along a longitudinal direction.

At the start of maintenance, the controller 11A moves the head cap 510 upward by the first drive mechanism 520, presses and abuts (mounts) the head cap 510 against the first inkjet head 130. The state of this abutment is shown in FIG. 7. The inclined surface 134B of the first protrusion 134 of the first inkjet head 130 and the inclined surface 514C of the first side wall 514A have the same inclination angle or the like, and the inclined surface 134B and the inclined surface 514C are brought together in an abutted state. Specifically, the first inclined surface 134BA and the first inclined surface 514CA are brought together and abutted against each other. The second inclined surface 134BB and the second inclined surface 514CB are brought together and abutted against each other. Furthermore, the inclined surface 135B of the second protrusion 135 of the first inkjet head 130 and the inclined surface 514D of the second side wall 514B have the same inclination angle, or the like and the inclined surface 135B and the inclined surface 514D are brought together in an abutted state. Specifically, the first inclined surface 135BA and the first inclined surface 514DA are brought together and abutted against each other. The second inclined surface 135BB and the second inclined surface 514DB are brought together and abutted against each other.

In the present embodiment, the inclined surfaces 134B and 135B of the first protrusion 134 and the second protrusion 135 of the first inkjet head 130 abut against the inclined surfaces 514C and 514D of the side walls 514 of the head cap 510, but other portions of the first inkjet head 130 are not abutted against the head cap 510. Specifically, the head cap 510 is not abutted against the lower surface 133 of the first inkjet head 130, and is also not abutted against the ejection surfaces 134A and 135A of the first protrusion 134 and the second protrusion 135. In particular, the side walls 514 are formed to a shape so as not to overlap the ejection surfaces 134A and 135A when viewed in the vertical direction, whereby the head cap 510 does not abut against the ejection surfaces 134A and 135A.

The abutment between the inclined surfaces facilitates positioning of the head cap 510 to the first inkjet head 130 at the time of abutment.

(Maintenance by Purge)

Figure 8:
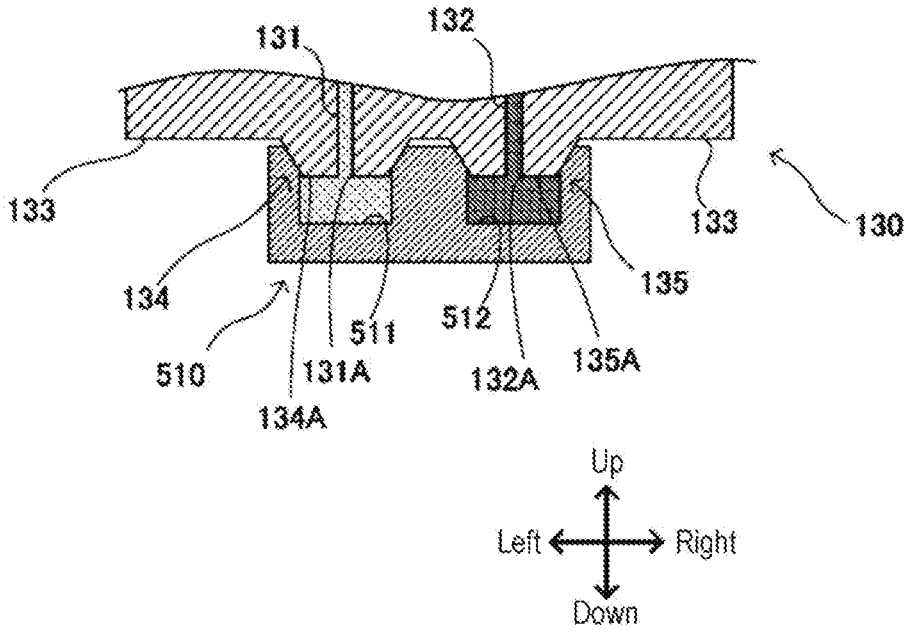
FIG. 8 is a cross-sectional view of that in which the head cap is mounted to the first inkjet head is taken along a short side direction showing a state after purge.

After the head cap 510 is mounted, the controller 11A performs a purge. Specifically, the controller 11A controls the pneumatic circuit 400 and supplies positive pressure to the 1-1 sub tank 110 and the 1-2 sub tank 120 for a predetermined time. As a result, the yellow ink is ejected from the plurality of ejection nozzles 131 (ejection ports 131A) of the first inkjet head 130. At this time, the controller 11A has the valve 532 of the suction device 530 closed. Therefore, the first recess 511 of the head cap 510 is filled with the yellow ink as shown in FIG. 8A. Similarly, the cyan ink is ejected from the plurality of ejection nozzles 132 (ejection ports 132A) of the first inkjet head 130, and the second recess 512 of the head cap 510 is filled with the cyan ink as shown in FIG. 8.

(Ink Suction)

Thereafter, the controller 11A controls and opens the valve 532 and controls and operates the pump 533. Thus, the suction device 530 suctions the yellow ink in the first recess 511 and discharges it to the waste liquid tank 534. Such suction is also performed on the cyan ink in the second recess 512. Each ink in the first recess 511 and the second recess 512 may not be completely removed, and ink may attach and remain on ejection surfaces 134A and 135A.

(Wiping)

Figure 9A:
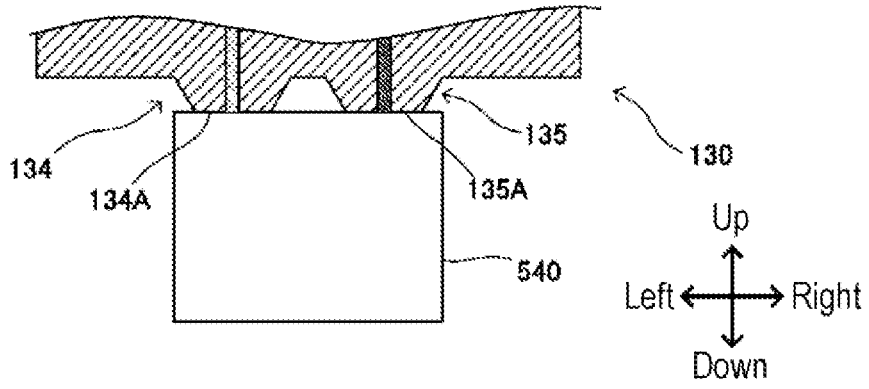
FIGS. 9A and 9B are views showing a state of wiping.
Figure 9B:
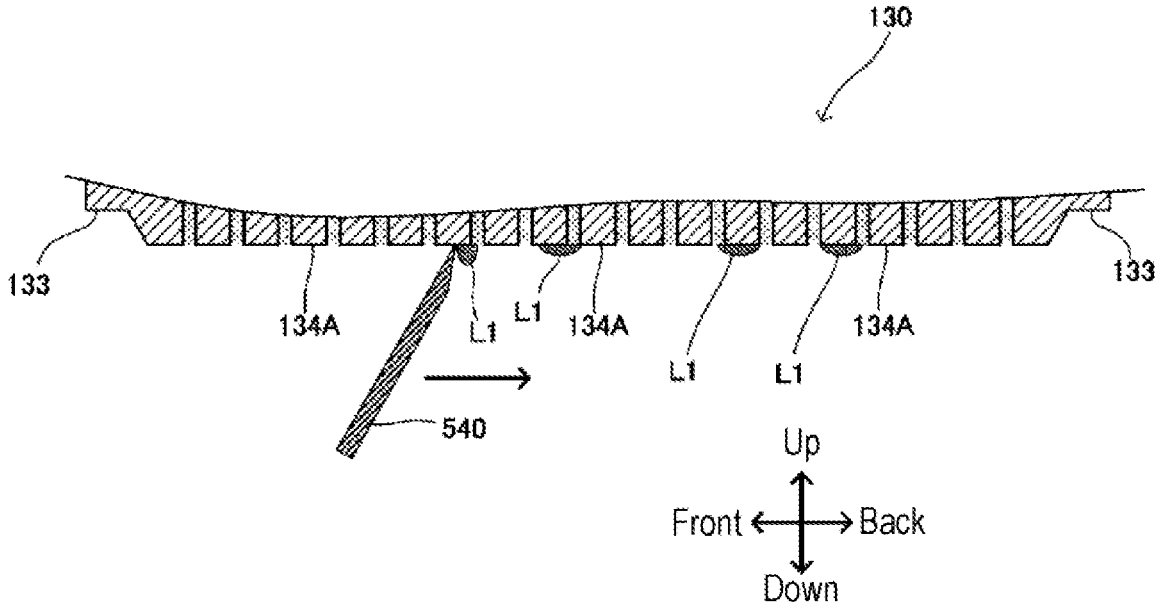

Thereafter, the controller 11A controls the second drive mechanism 550 to move the wiping blade 540 in the sub scanning direction while simultaneously bringing the wiping blade 540 into contact with the ejection surfaces 134A and 135A (see FIGS. 9A and 9B; wiping). Thus, the ink attached to the ejection surfaces 134A and 135A (see residual ink L in FIG. 9B) can be wiped from both ejection surfaces 134A and 135A all at once.

(Effects of the Present Embodiment)

Figure 10A:
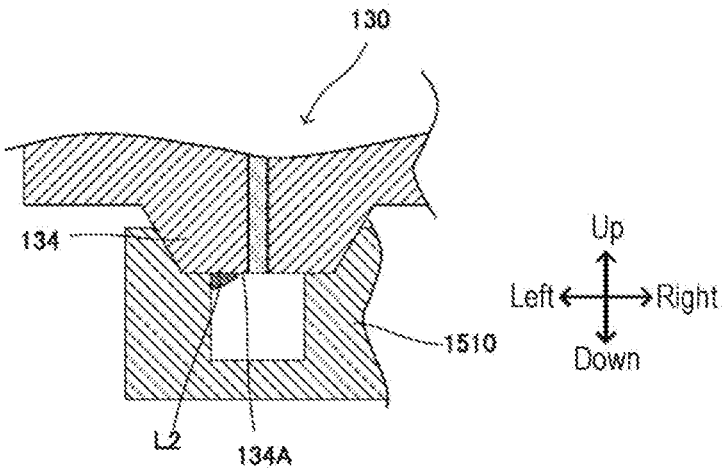
FIG. 10A (Related Art)
FIGS. 10A to 10C are explanatory views of a conventional head cap.
Figure 10B:
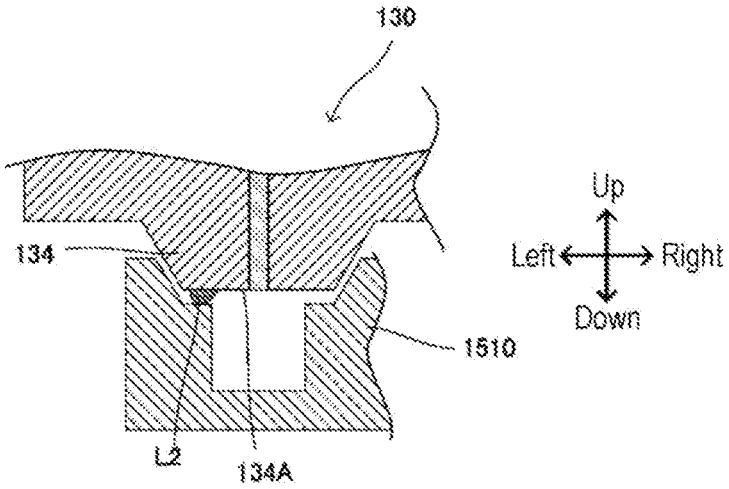
FIG. 10B (Related Art)
Figure 10C:
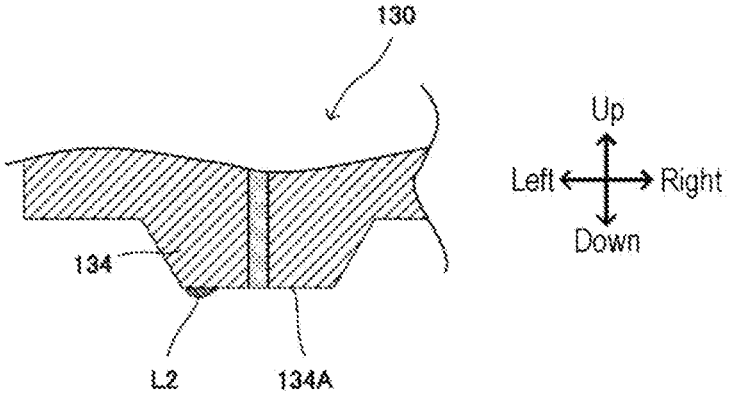
FIG. 10C (Related Art)

As shown in FIGS. 10A to 10C, when the conventional head cap 1510 is mounted to the first inkjet head 130, a part of the upper end thereof abuts against the ejection surface 134A of the first protrusion 134. In this case, even if the ink is suctioned, the ink L2 remains at the corner of the abutment portion between the head cap 1510 and the ejection surface 134A (FIG. 10A). In such a case, the ink L2 enters the gap formed when the head cap 1510 is separated from the first inkjet head 130 (FIG. 10B), and the ink L2 remains on the ejection surface 134A even when the head cap 1510 is completely separated from the first inkjet head 130. Even in a state in which the head cap 1510 is mounted to the first inkjet head 130, the ink L2 remains similar to the above if there is a gap between the head cap 1510 and the ejection surface 134A. In this case, the ink L2 may be moved and dried at the ejection port 131A by the wiping of the wiping blade 540, and the ejection port 131A may get clogged. Furthermore, since the wiping by the wiping blade 540 is collectively performed on both the ejection surface 134A and the ejection surface 135A, the ink L2 (yellow ink) may move to the ejection port 132A of the cyan ink and the color mixture (mixing of color of ink ejected from ejection port 132A) may occur. The ejection surface 134A is normally subjected to water-repellent treatment, but the water-repellency degrades due to the aging degradation. With such a degradation, the amount of ink L2 increases, and the clogging or color mixing appears notably.

Figure 11A:
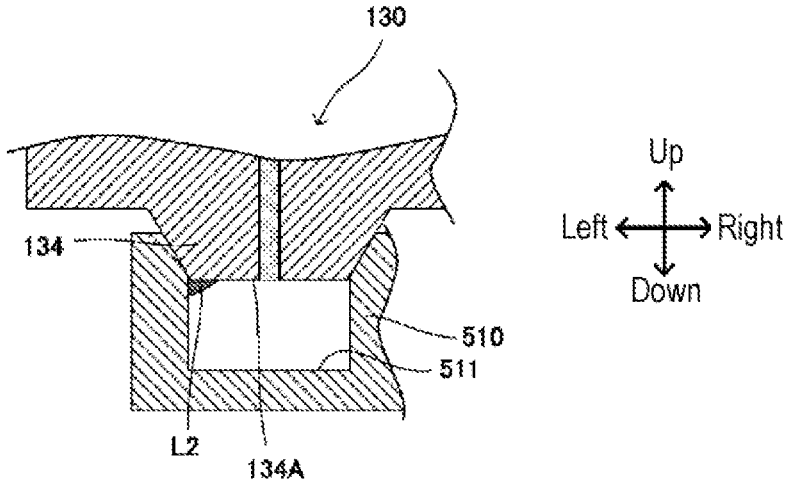
FIGS. 11A to 11C are views for explaining the effects of the embodiment.
Figure 11B:
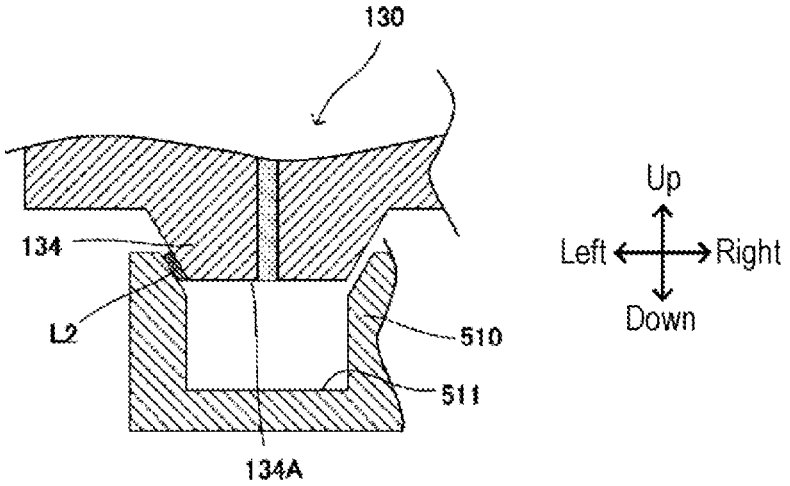
Figure 11C:
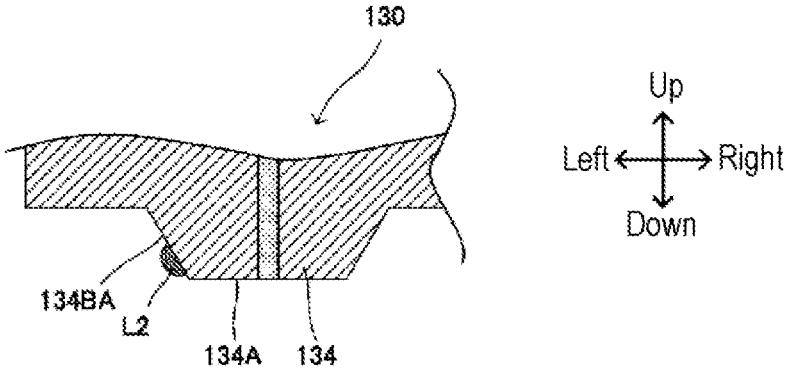

In this embodiment, when the head cap 510 is mounted to the first inkjet head 130, the upper ends of the side walls 514 of the head cap 510 do not abut against the ejection surfaces 134A and 135A. In such a case, similar to the case of FIG. 10C, even if the ink L2 remains at the corner (FIG. 11A), the ink L2 can be guided to the gap formed when the head cap 510 is separated from the first inkjet head 130 (FIG. 11B). In such a case, even if the head cap 510 is completely separated from the first inkjet head 130, the ink L2 remains on the first inclined surface 134BA but does not remain on the ejection surface 134A (FIG. 11C). Thus, the amount of ink remaining on the ejection surface 134A is reduced, and the clogging and color mixing that occur in the subsequent wiping by the wiping blade 540 are also prevented. In particular, even if the water repellency is degraded, the clogging or color mixing can be effectively prevented.

(Modifications)

The present disclosure is not limited to the embodiment described above. The embodiment described above may be modified in various manners. A known method can be adopted for the maintenance such as the purge.

(First Modification)

The maintenance may be, for example, flushing (ejection of ink) or suction of ink in the ejection nozzle. Even in these cases, it is assumed that remaining of ink L2 as shown in FIGS. 10A to 10C and FIGS. 11A to 11C (in particular, in the case where the ink is scattered) may occur, and hence the present disclosure can also be applied to flushing and the suction described above. However, as the remaining of ink L2 significantly appears at the time of purge, the present disclosure is particularly effective in an inkjet printer that performs purge.

(Second Modification)

In the description made above, when the head cap 510 is mounted to the first inkjet head 130, not all the upper ends of the side walls 514 of the head cap 510 abut against the ejection surfaces 134A and 135A, but a part of the upper ends may abut against the ejection surfaces 134A and 135A. For example, the side wall 514 may be formed to a shape in which all the portions extending in the longitudinal direction of the side wall 514 do not abut against the ejection surface 134A or 135A (e.g., do not overlap when viewed from the vertical direction), and at least a part of the portion extending in the short side direction abuts against the ejection surface 134A or 135A. Furthermore, the side wall 514 may be formed to a shape in which all the portions extending in the short side direction of the side wall 514 do not abut against the ejection surface 134A or 135A (e.g., do not overlap when viewed from the vertical direction), and at least a part of the portion extending in the longitudinal direction abuts against the ejection surface 134A or 135A. Even in such a case, the amount of ink remaining on the ejection surface after maintenance is less than in a mode in which all the upper ends are abutted against the ejection surfaces 134A and 135A.

(Third Modification)

Figure 12:
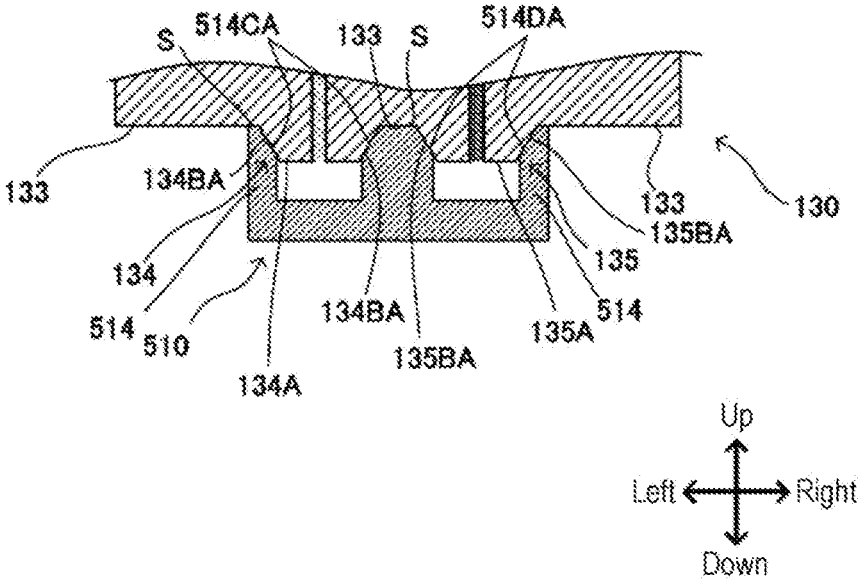
FIG. 12 is a cross-sectional view of than in which a head cap according to a modification is mounted to the first inkjet head is taken along a short side direction.

The upper end of the side wall 514 of the head cap 510 may be abutted against the lower surface 133 of the first inkjet head 130. For example, as shown in FIG. 12, the side wall 514 may be formed to a shape in which that the upper surface S of the side wall 514 abuts against the lower surface 133, in addition to the inclined surface 134B of the first inkjet head 130 and the like abutting against the inclined surface 514C and the like.

(Fourth Modification)

The ejection surface 134A and the like may have some steps. For example, even if there is a step, if the surface is to be wiped as a whole, such a surface is the ejection surface. Furthermore, the lower surface surrounded by the inclined surface (top of protrusion having inclined surface as side surface) constitutes the ejection surface as a whole even if there is a slight step.

(Fifth Modification)

The wiping blade 540 (one example of wiping member) may be changed to another wiping member (member that performs wiping (wiping, brushing, etc.)). Moreover, the moving direction may be the main scanning direction.

What is claimed is:

1. An inkjet printer comprising:

an inkjet head, including a first protrusion that protrudes downward, the first protrusion having a lower surface provided with a first ejection port for ejecting a first ink as a first ejection surface, and a second protrusion that protrudes downward, the second protrusion having a lower surface provided with a second ejection port for ejecting a second ink as a second ejection surface; and a head cap, mounted to the inkjet head when the first ink and the second ink are respectively ejected from the first ejection port and the second ejection port to perform a maintenance on the inkjet head, wherein the head cap includes:

a first bottom portion, a first side wall extending from the first bottom portion toward a side of the inkjet head, a second bottom portion, a second side wall extending from the second bottom portion toward the side of the inkjet head, and a third side wall being disposed between the first side wall and the second side wall, and extending toward the side of the inkjet head;

wherein the first bottom portion and the first side wall form a first recess that covers the first ejection port when the head cap is mounted to the inkjet head, the second bottom portion and the second side wall form a second recess that covers the second ejection port when the head cap is mounted to the inkjet head;

wherein the first protrusion and the second protrusion of the inkjet head are configured to be separated by the third side wall of the head cap that is protruded toward the inkjet head, and the first protrusion and the second protrusion are configured to be in contact with an abutting surface of the head cap in the same state;

the first protrusion includes a side surface having a first inclined surface, the upper end portion of the first side wall includes an abutment portion that abuts against the first inclined surface, and below a lower end of the abutment portion is a surface having an angle closer to vertical than a second inclined surface of the abutment portion;

when the head cap is mounted to the inkjet head, the first side wall has a shape in which at least a part of an upper end portion of the first side wall abuts against a region at a periphery of the first ejection surface and does not abut against the first ejection surface, the side surface and the abutment portion are in contact with each other, and a lower end of the side surface and a lower end of the abutment portion are substantially at the same position.

2. The inkjet printer according to claim 1, wherein the upper end portion of the first side wall includes the abutment portion that abuts against the first inclined surface and a periphery of the side surface of the inkjet head.

3. The inkjet printer according to claim 2, wherein the maintenance is a maintenance by purge.

4. The inkjet printer according to claim 2, wherein the first ejection surface is a surface from which the first ink is wiped by wiping.

5. The inkjet printer according to claim 2, wherein the inkjet printer further includes a wiping member that collectively wipes the first ejection surface and the second ejection surface after the maintenance, and the second side wall has a shape in which at least a part of an upper end portion of the second side wall abuts against a region at a periphery of the second ejection surface and does not abut against the second ejection surface when the head cap is mounted to the inkjet head.

6. The inkjet printer according to claim 1, wherein the maintenance is a maintenance by purge.

7. The inkjet printer according to claim 6, wherein the first ejection surface is a surface from which the first ink is wiped by wiping.

8. The inkjet printer according to claim 6, wherein the inkjet printer further includes a wiping member that collectively wipes the first ejection surface and the second ejection surface after the maintenance, and the second side wall has a shape in which at least a part of an upper end portion of the second side wall abuts against a region at a periphery of the second ejection surface and does not abut against the second ejection surface when the head cap is mounted to the inkjet head.

9. The inkjet printer according to claim 1, wherein the first ejection surface is a surface from which the first ink is wiped by wiping.

10. The inkjet printer according to claim 9, wherein the inkjet printer further includes a wiping member that collectively wipes the first ejection surface and the second ejection surface after the maintenance, and the second side wall has a shape in which at least a part of an upper end portion of the second side wall abuts against a region at a periphery of the second ejection surface and does not abut against the second ejection surface when the head cap is mounted to the inkjet head.

11. The inkjet printer according to claim 1, wherein the inkjet printer further includes a wiping member that collectively wipes the first ejection surface and the second ejection surface after the maintenance, and the second side wall has a shape in which at least a part of an upper end portion of the second side wall abuts against a region at a periphery of the second ejection surface and does not abut against the second ejection surface when the head cap is mounted to the inkjet head.

12. An inkjet printer comprising:

an inkjet head, including a first protrusion that protrudes downward, the first protrusion having a lower surface provided with a first ejection port for ejecting a first ink as a first ejection surface, and a second protrusion that protrudes downward, the second protrusion having a lower surface provided with a second ejection port for ejecting a second ink as a second ejection surface; and a head cap, mounted to the inkjet head when the first ink and the second ink are respectively ejected from the first ejection port and the second ejection port to perform a maintenance on the inkjet head;

wherein the head cap includes:

a first bottom portion, a first side wall extending from the first bottom portion toward a side of the inkjet head, a second bottom portion, a second side wall extending from the second bottom portion toward the side of the inkjet head, and a third side wall being disposed between the first side wall and the second side wall, and extending toward the side of the inkjet head;

wherein the first bottom portion and the first side wall form a first recess that covers the first ejection port when the head cap is mounted to the inkjet head, the second bottom portion and the second side wall form a second recess that covers the second ejection port when the head cap is mounted to the inkjet head;

wherein the first protrusion and the second protrusion of the inkjet head are configured to be separated by the third side wall of the head cap that is protruded toward the inkjet head, and the first protrusion and the second protrusion are configured to be in contact with an abutting surface of the head cap in the same state.

* * * * *